US007300567B2

(12) United States Patent
Breivik et al.

(10) Patent No.: US 7,300,567 B2
(45) Date of Patent: Nov. 27, 2007

(54) HYDROTREATING PROCESS

(75) Inventors: Rasmus Breivik, Hillerød (DK); Johan Mogensen, Frederiksberg C (DK); Kim Grøn Knudsen, Hellerup (DK); Johannes Wrisberg, Holte (DK); Bent Sarup, Frederiksberg C (DK)

(73) Assignee: Haldor Topsoe A/S, Lyngby (DK)

( * ) Notice: Subject to any disclaimer, the term of this patent is extended or adjusted under 35 U.S.C. 154(b) by 603 days.

(21) Appl. No.: 10/862,398

(22) Filed: Jun. 8, 2004

(65) Prior Publication Data

US 2004/0251169 A1 Dec. 16, 2004

(30) Foreign Application Priority Data

Jun. 10, 2003 (DK) ..... 2003 00858

(51) Int. Cl.
*C10G 65/04* (2006.01)
*C10G 45/00* (2006.01)

(52) U.S. Cl. ..... 208/210; 208/89; 208/213; 208/254 H

(58) Field of Classification Search ..... 208/89, 208/210, 213, 254 H
See application file for complete search history.

(56) References Cited

U.S. PATENT DOCUMENTS 4,755,280 A * 7/1988 Hudson et al. ..... 208/89
5,403,470 A 4/1995 Kokayeff et al.
2002/0148757 A1* 10/2002 Huff et al. ..... 208/213

* cited by examiner

*Primary Examiner*—Glenn Caldarola
*Assistant Examiner*—Prem C. Singh
(74) *Attorney, Agent, or Firm*—Dickstein Shapiro LLP

(57) ABSTRACT

Process for the removal of coloured compounds in a hydrocarbon feedstock comprising the steps of hydrotreating the feedstock in presence of a first hydrotreating catalyst under conditions being effective in hydrogenation of hydrogenable compounds being present in the feedstock and hydrotreating an effluent from the first hydrotreating step in a second catalytic hydrotreating step being carried out in a second hydrotreating reactor at hydrotreating conditions, wherein the effluent from the first hydrotreating step is separated into a gas phase and a mixed gas and liquid phase prior to the second hydrotreating step, and the mixed phase is hydrotreated in the second hydrotreating step without further addition of hydrogen.

3 Claims, 1 Drawing Sheet

HYDROTREATING PROCESS

Figure 1:
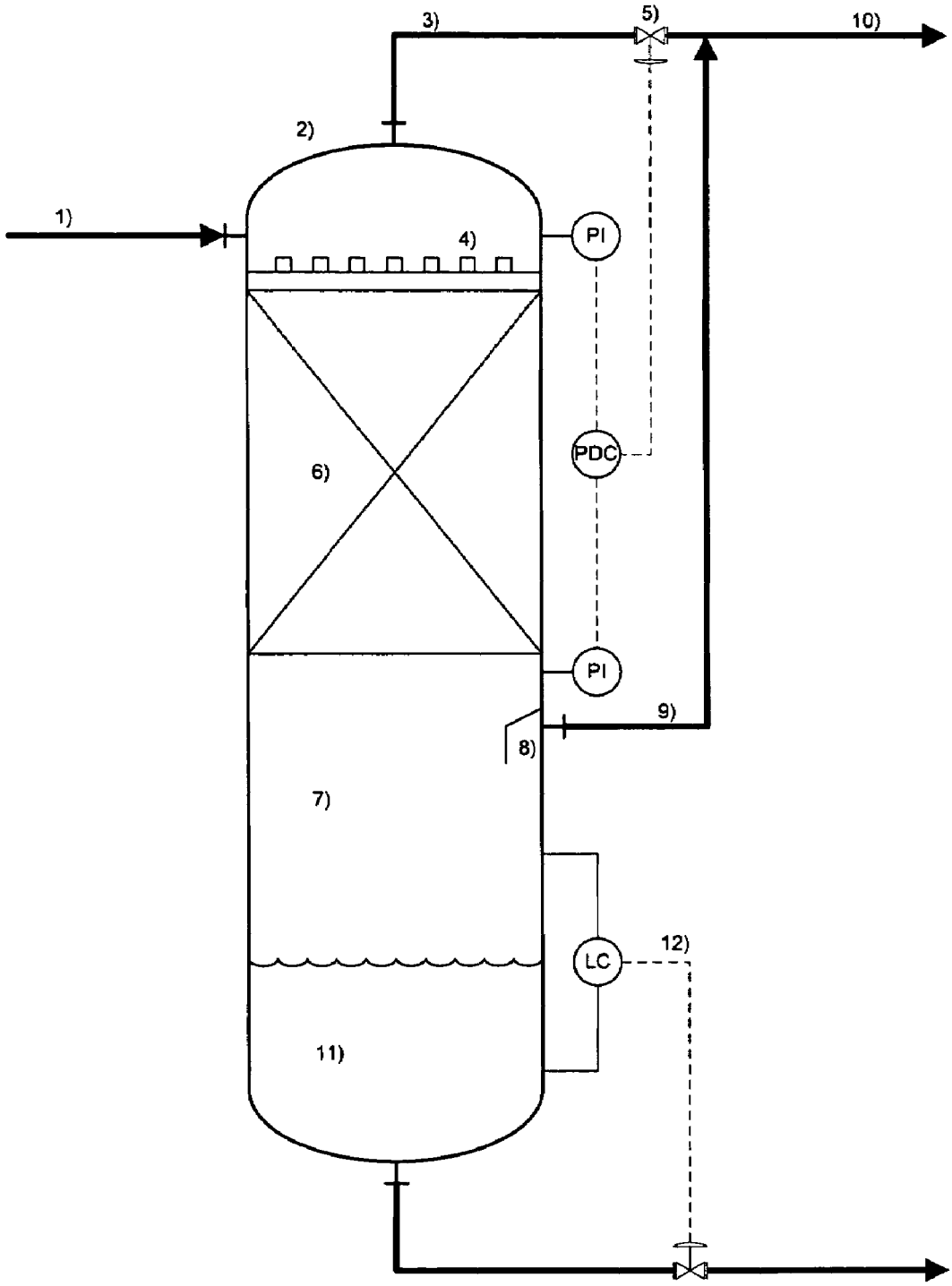

This invention relates to a catalytic conversion process involving hydrogen and hydrocarbons containing heteroatoms such as sulphur and nitrogen, known as hydrotreating. In particular the invention is related to a process for removing coloured components from hydrocarbon streams, in particular diesel fuel streams, to provide a significant improvement in the colour of the product.

Hydrotreating of hydrocarbons at the refinery allows large scale removal and handling of sulphur and nitrogen compounds such that the environmental impact when burning such hydrocarbon fuels in the form of SOx and NOx is considerably reduced without having to resort too expensive exhaust cleaning systems for each consumer. The increased demand for clean diesel fuels has also led to an increase in process severity to reach very low levels of sulphur and nitrogen as well as the ability to hydrotreat feedstocks that are harder to convert (higher endpoints, cracked stocks). An increase in processing severity in particular increased reaction temperature is known to lead to an increased concentration of undesirable coloured components in the desulphurized product.

In order to maintain stability and reactivity of the catalyst a hydrogen rich process gas (also called treat gas) is used in considerable surplus compared to the hydrogen used for reaction (typically in the range from 2-6 times the chemical requirement). The chemical hydrogen consumption as well as the required surplus tends to increase as the feedstocks contain more cracked material or have higher endpoints.

Reduction of the reaction temperature by increasing the amount of catalyst or by increasing the reaction pressure both involves considerable capital costs. A process to reduce the concentration of such coloured components at minimum expenditure (capital investment and operating cost) is therefore of considerable interest in view of these developments.

In a conventional hydrotreating process a hydrocarbon mixture has been reacted with a treat gas containing surplus hydrogen relative to the chemical requirements at relatively high severity to react sulphur and nitrogen compounds in the hydrocarbon mixture to gaseous components (hydrogen sulphide and ammonia). The effluent from this upstream reactor will contain the unreacted part of the treat gas including hydrogen sulphide and ammonia and will also contain the treated hydrocarbon phase containing coloured components.

Most commonly this reactor effluent is heat exchanged with the hydrocarbon containing feed to the reactor in a feed/effluent heat exchanger to increase the energy efficiency of the process. Upon transfer of heat from the reactor effluent to the reactor feed a large part of the hydrocarbon vapours in the gas phase will condense and be added to the liquid phase, where essentially all the coloured components are present. Also the cooled reactor effluent is very often sent to a hot separator flash vessel, where the effluent is separated into a hydrogen rich gaseous phase and a hydrocarbon rich liquid phase.

U.S. Pat. No. 5,403,470 teaches removal of coloured components by treating essentially all of the reactor effluent by using a relatively small reactor volume containing a hydrotreating catalyst, where the reactor is in series with the main hydrotreating reactors. As the main disadvantage, this process requires treating of all of the treat gas, which is essentially devoid of coloured components, which significantly restricts the design of optimum process schemes for contacting the fluid and the catalyst.

It is therefore the general object of the invention to provide a simplified hydrotreating process for decolourising a hydrocarbon feed stock.

Accordingly, the invention provides an improved hydrotreating process for the removal of coloured compounds in a hydrocarbon feedstock, wherein the hydrocarbon feedstock is hydrotreated in presence of a first hydrotreating catalyst under conditions being effective in hydrogenation of hydrogenable compounds being present in the feedstock. The effluent from the first hydrotreating step is then further hydrotreated in a second catalytic hydrotreating step at hydrotreating conditions. The improvement of the process comprises separating the effluent from the first hydrotreating step into a gas phase and a mixed gas and liquid phase prior to the second hydrotreating step, and treating the mixed phase in the second hydrotreating step without addition of hydrogen.

When operating the process in accordance with a general embodiment of invention, the effluent from the first hydrotreating step consists of a gas phase and a liquid phase. The gas phase comprises mainly C1-C4 hydrocarbons and hydrogen together with minor amounts of ammonia and hydrogen sulphide being formed in the first hydrotreating step. The liquid phase contains C5 and higher hydrocarbons. Major part of the gas phase is separated from the effluent in a separator upstream the second hydrotreating step. The remaining mixed gas-liquid phase is passed to the second hydrotreating step for removal of coloured components. Volume ratio of gas and liquid in the mixed phase depends on the amount of coloured components in the liquid phase and the amount of hydrogen being necessary in the second hydrotreating step for hydrogenation of those components. In praxis, the volume ratio will be adjusted by controlling the pressure drop over the catalyst bed in the second hydrotreating step by means of a valve mounted in a purge gas line for withdrawal of part of the gas phase in the effluent from the first hydrotreating step. The pressure drop is then adjusted, so that hydrogen is present in the mixed gas-liquid phase corresponding to the at least stoichiometric amount for hydrotreating of the mixed phase in the second step.

Suitable catalysts for use in the invention are any of the known hydrotreating catalysts. Particular useful catalysts are the conventional hydrogenation catalyst comprising metal or metal compounds selected from nickel, cobalt, molybdenum and tungsten.

Process conditions being effective in hydrotreating comprise operation temperatures in the first in the range between 300° C. and 450° C., particularly between 340° C. and 430° C.

Suitable operation temperatures in the second hydrotreating step will be between 220° C. and 350° C.

The partial hydrogen pressure in the hydrotreating reactors generally ranges between 20 and 70 bar, in particular between 30 and 60 bar.

The inventive process is furthermore useful to improve conventional hydrotreating processes and plants, when a hydrocarbon rich liquid phase from a first conventional hydrotreating reactor is treated with stoichiometric or a minimum of surplus hydrogen in a second hydrotreating reactor being provided with a hot separation flash operation at top of the reactor.

The invention is explained in more detail in the following description with reference to the drawings, in which FIG. 1 schematically shows process flow according to an embodiment of the invention.

Reactor effluent 1 from a first conventional hydrotreating reactor (not shown) is introduced into modified second hydrotreating reactor 2 with a hot flash separator in the top section of the reactor. In other embodiments of the invention, the hot flash separator may be arranged externally and upstream to the second reactor. The major part of gas phase in effluent 1 leaves overhead through purge line 3. The liquid phase with the remaining part of the gas phase proceeds to a vapour-liquid distributor 4 and hydrotreating catalyst 6 for removal of coloured compounds in the mixed gas and liquid phase. Pressure control valve 5, e.g. a butterfly valve, in line 3 is used to control the split of gas phase flow between line 3 and catalyst 6 and the volume ratio between gas and liquid phase being passed through the catalyst as described above. The catalyst is effective in the removal and/or conversion of colour bodies from the hydrocarbon-containing liquid or gas.

Surplus of hydrogen and excess gas being present in the effluent 7 from catalyst 6 are disengaged from the liquid phase in space 8 at bottom of reactor 2 and withdrawn through gas outlet 8 and pressure equalizing line 9. The gas phase in lines 8 and 9 is combined with the gas phase in line 3. The combined gas flow in line 10 proceeds to further product recovery operations. A liquid level of decolorized hydrocarbon liquid 11 is maintained in the modified hot separator 2 by means of a conventional liquid level control scheme 12.

As further an advantage of the above described flow scheme, removal of major part of the gas phase in the flash separator allows control of the pressure drop across the catalyst bed 6. Thereby, additional pressure-handling equipment is superfluous.

The invention claimed is:

1. A process for the removal of coloured compounds in a hydrocarbon feedstock comprising the steps of:

hydrotreating the feedstock in presence of a first hydrotreating catalyst under conditions being effective in hydrogenation of hydrogenable compounds being present in the feedstock; and hydrotreating the total effluent from the first hydrotreating step in a second catalytic hydrotreating step being carried out in a second hydrotreating reactor at hydrotreating conditions, in which the effluent from the first hydrotreating step is separated within said second hydrotreating reactor into a first gas phase and a second mixed gas and liquid phase, and the second mixed gas and liquid phase is hydrotreated in the second hydrotreating step without further addition of hydrogen to obtain a decolorized hydrocarbon liquid.

2. The process according to claim 1, wherein volume ratio between gas and liquid in the mixed phase is adjusted to provide an amount of hydrogen in the second mixed gas and liquid phase being at least stoichiometric to the amount of hydrogenable compounds in the mixed phase.

3. The process according to claim 1, wherein separation of the effluent from the first hydrotreating step is performed in the second hydrotreating reactor.

* * * * *